US009797410B1

(12) United States Patent
Tucker

(10) Patent No.: US 9,797,410 B1
(45) Date of Patent: Oct. 24, 2017

(54) ADJUSTABLE WALL MOUNTED FAN

(71) Applicant: Lawrence Tucker, Garberville, CA (US)

(72) Inventor: Lawrence Tucker, Garberville, CA (US)

( * ) Notice: Subject to any disclaimer, the term of this patent is extended or adjusted under 35 U.S.C. 154(b) by 283 days.

(21) Appl. No.: 14/623,946

(22) Filed: Feb. 17, 2015

(51) Int. Cl.
*F04D 29/60* (2006.01)
*F24F 13/32* (2006.01)

(52) U.S. Cl.
CPC ..... *F04D 29/601* (2013.01); *F24F 13/32* (2013.01)

(58) Field of Classification Search
CPC ..... B66F 3/242; B66F 1/06; F04D 29/601; F04D 29/563; F04D 29/603; F04D 29/646; F04D 29/703; F24F 13/32; F24F 13/18; F16M 11/24; F16M 11/28; F16M 11/26; F16B 7/10; F16B 7/105
USPC ..... 248/161
See application file for complete search history.

(56) References Cited

U.S. PATENT DOCUMENTS 1,761,003 A * 6/1930 Womrath ..... F16H 7/18 160/104
1,882,366 A * 10/1932 Lytton ..... F04D 29/646 15/312.1
2,521,920 A * 9/1950 Koch ..... F04D 29/646 248/161
4,073,499 A * 2/1978 Damone ..... B62B 7/04 280/1.23
D328,786 S 8/1992 Obson
D336,333 S * 6/1993 Cook ..... D23/378
5,411,372 A 5/1995 Clark
5,522,704 A 6/1996 Casteel
5,558,501 A 9/1996 Wang
D395,496 S 6/1998 Wang
5,845,886 A 12/1998 McCormick
7,833,139 B1 * 11/2010 Endelman ..... A63B 21/154 254/414
8,348,220 B2 1/2013 Carter
2005/0092888 A1 5/2005 Gonce
2009/0308999 A1 * 12/2009 Kim ..... F16M 11/048 248/299.1
2009/0314216 A1 * 12/2009 Polak ..... A01K 1/0082 119/174
2011/0147557 A1 * 6/2011 In ..... A47G 1/164 248/295.11
2014/0112791 A1 * 4/2014 Abell ..... F04D 25/084 416/159
2014/0117195 A1 * 5/2014 Lin ..... F16M 11/12 248/474

FOREIGN PATENT DOCUMENTS

CN 103711732 A * 4/2014
GB 2223792 A * 4/1990 ..... E04G 1/32

OTHER PUBLICATIONS

Machine Translation of CN 103711732 A.*
STIC Patent Search.*

* cited by examiner

*Primary Examiner* — Nathaniel Wiehe
*Assistant Examiner* — Elton Wong

(57) ABSTRACT

The adjustable wall mounted fan is a device comprising a frame, a mounting plate, a detent, and a positioning device. The frame, mounting plate, and a fan are mounted on the wall. The positioning device raises and lowers the fan vertically and the detent is used to hold the fan is position. The adjustable wall mounted fan is used to improve ventilation in a room.

2 Claims, 4 Drawing Sheets

ADJUSTABLE WALL MOUNTED FAN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of ventilation and wall and ceiling mount fans, more specifically, an adjustable wall mounted fan.

SUMMARY OF INVENTION

The adjustable wall mounted fan is a device comprising a frame, a mounting plate, a fan, a detent, and a positioning device. The frame, mounting plate, and fan are mounted on the wall. The positioning device raises and lowers the fan vertically and the detent is used to hold the fan is position.

These together with additional objects, features and advantages of the adjustable wall mounted fan will be readily apparent to those of ordinary skill in the art upon reading the following detailed description of the presently preferred, but nonetheless illustrative, embodiments when taken in conjunction with the accompanying drawings.

In this respect, before explaining the current embodiments of the adjustable wall mounted fan in detail, it is to be understood that the adjustable wall mounted fan is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the adjustable wall mounted fan.

It is therefore important that the claims be regarded as including such equivalent construction insofar as they do not depart from the spirit and scope of the adjustable wall mounted fan. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
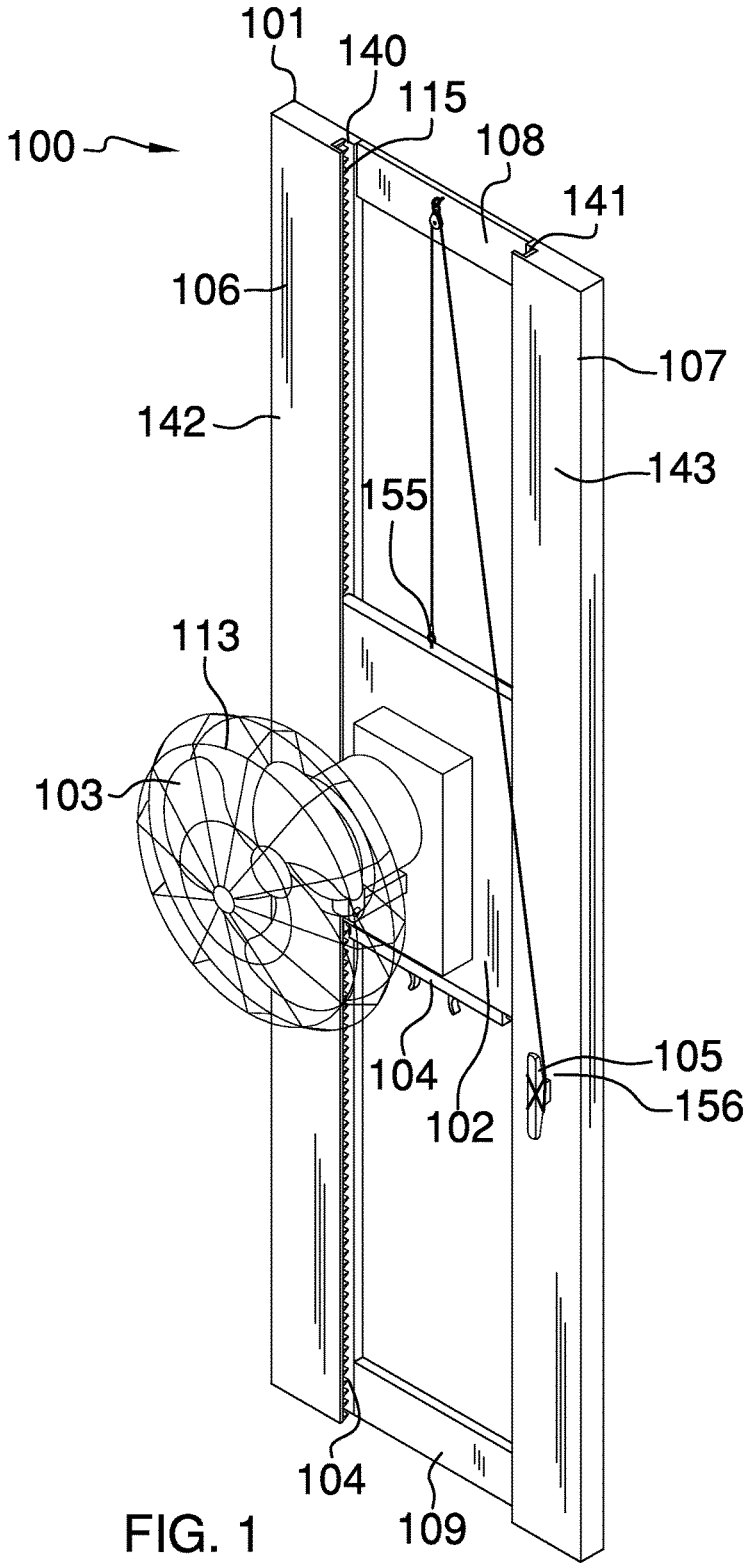
FIG. 1 is a perspective view of an embodiment of the disclosure.
Figure 2:
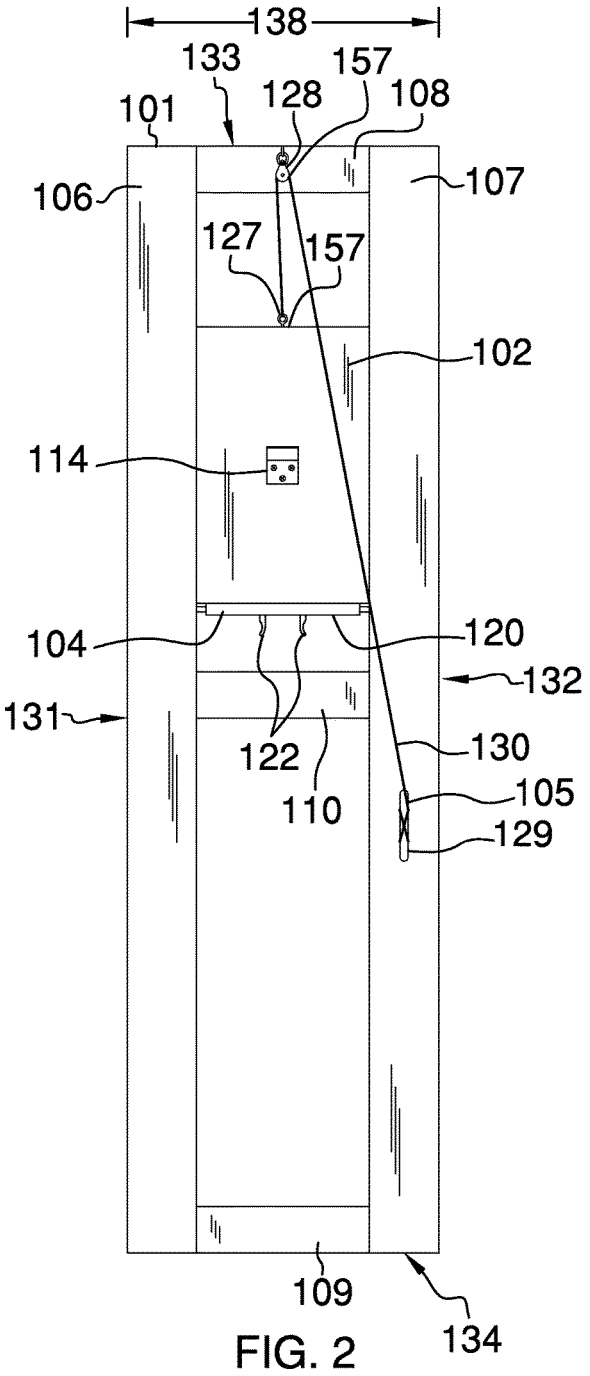
FIG. 2 is a front view of an embodiment of the disclosure.
Figure 3:
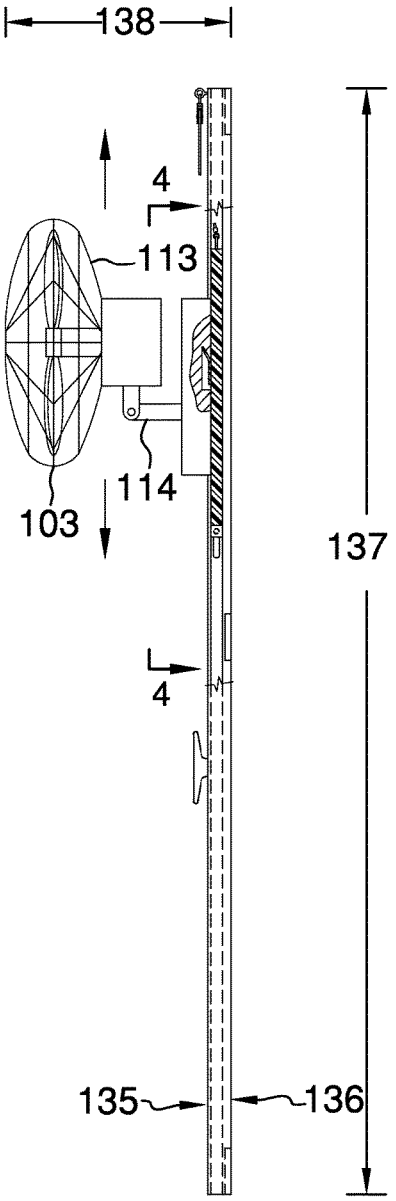
FIG. 3 is a side view of an embodiment of the disclosure.
Figure 4:
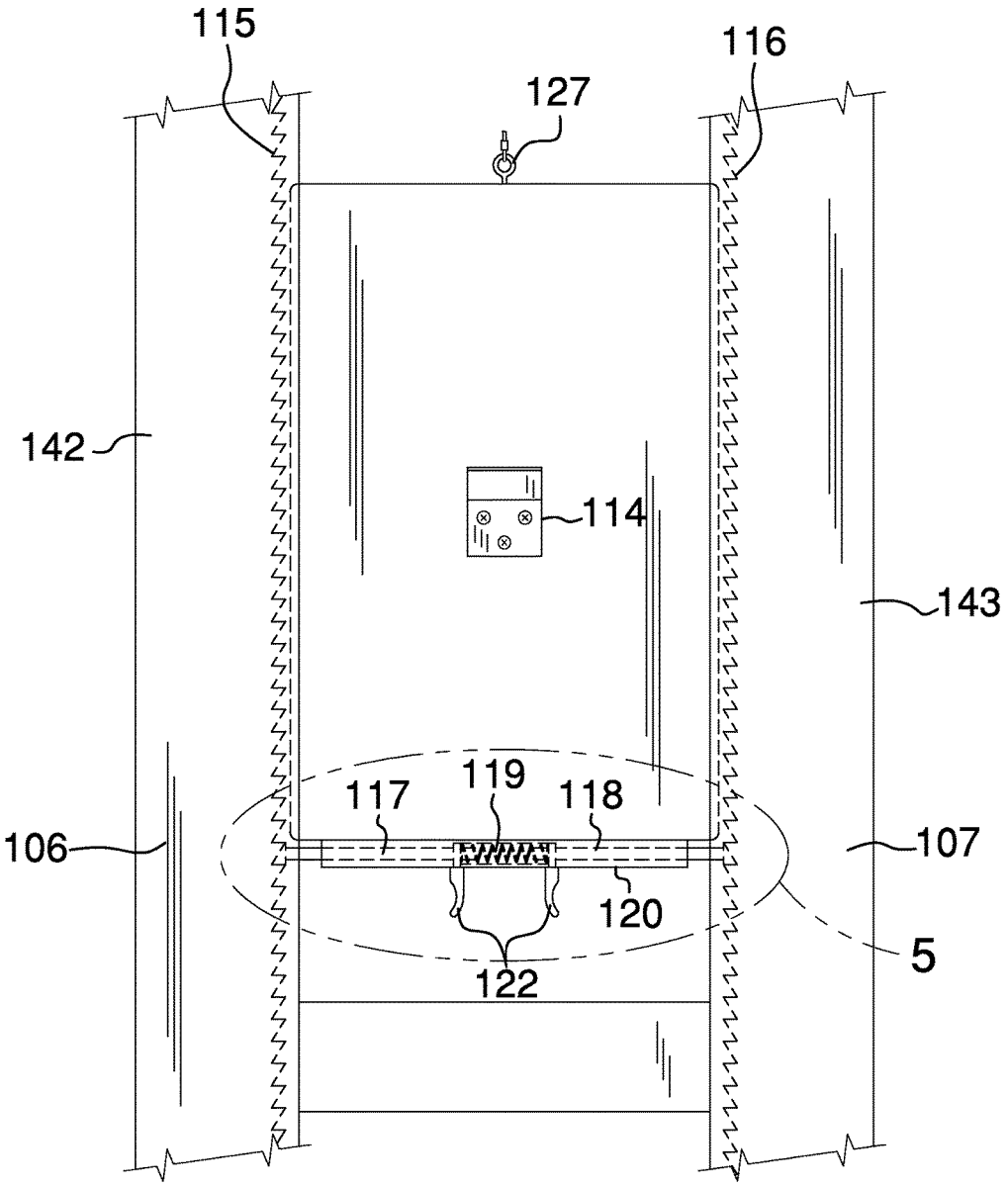
FIG. 4 is a cross-sectional view of an embodiment of the disclosure across line 4-4 in FIG. 3.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 5. The adjustable wall mounted fan 100 (hereinafter invention) includes a frame 101, a mounting plate 102, a fan 103, a detent 104, and a positioning device 105. The frame 101 comprises a left rail 106, a right rail 107, a top cross brace 108, and a bottom cross brace 109.

The left rail 106 comprises a left plank 142 and a left groove 140. The left plank 142 is a plate or board that is on a left 131 side of the invention 100. A right 132 side of the left plank 142 includes a left groove 140 along a height 137 of the left plank 142. The right rail 107 comprises a right plank 143 and a right groove 141. The right plank 143 is a plate or board that is located on the right 132 side of the invention 100.

The left 131 side of the right plank 143 includes a right groove 141 along the height 137 of the right plank 143. The top cross brace 108 is a plate or board that is used to connect the left rail 106 to the right rail 107. The top cross brace 108 is further defined with a left 131 end and a right 132 end. The left 131 end of the top cross brace 108 is attached to the left rail 106. The right 132 end of the top cross brace 108 is attached to the right rail 107. The bottom cross brace 109 is a plate or board that is used to connect the left rail 106 to the right rail 107. The bottom cross brace 109 is further defined with a left 131 end and a right 132 end. The left 131 end of the bottom cross brace 109 is attached to the left rail 106. The right 132 end of the bottom cross brace 109 is attached to the right rail 107.

The span of the height 137 of the left rail 106 is equal to the span of the height 137 of the right rail 107. The span of the width 138 of the top cross brace 108 is equal to the span of the width 138 of the bottom cross brace 109. The left rail 106 is positioned to be parallel to the right rail 107. The top cross brace 108 is positioned to be parallel to the bottom cross brace 109. The top cross brace 108 is positioned to be perpendicular to both the left rail 106 and the right rail 107. The bottom cross brace 109 is positioned to be perpendicular to both the left rail 106 and the right rail 107. The width 138 and depth 139 of the left groove 140 is identical to the width 138 and the depth 139 of the right groove 141.

An optional middle cross brace 110 can be added to the invention 100. The optional middle cross brace 110 is a plate or board that is used to connect the left rail 106 to the right rail 107. The optional middle cross brace 110 is further defined with a left 131 end and a right 132 end. The left 131 end of the optional middle cross brace 110 is attached to the left rail 106. The right 132 end of the optional middle cross brace 110 is attached to the right rail 107. When used the optional middle cross brace 110 is used, the span from the bottom 134 of the left rail 106 to the bottom 134 of the optional middle cross brace 110 is between 25% and 75% of the span from the bottom 134 of the left rail 106 to the top 133 of the left rail 106. When used the optional middle cross brace 110 is positioned to be perpendicular to both the left rail 106 and the right rail 107. In the first potential embodiment of the disclosure, as illustrated in FIGS. 1 through 5, the optional middle cross brace 110 is used.

The frame 101 can be made of wood, metal, or plastic. If wood is selected, the top cross brace 108, bottom cross brace 109, and optional middle cross brace 110 can each be joined to the left rail 106 and the right rail 107 using a variety of methods including, but not limited to, commercially available hardware. If metal is selected, the top cross brace 108, bottom cross brace 109, and optional middle cross brace 110 can each be joined to the left rail 106 and the right rail 107 using a variety of methods including, but not limited to, welding or brazing. If plastic is selected, a series of joints can be formed to connect the top cross brace 108, bottom cross brace 109, and optional middle cross brace 110 to the left rail 106 and the right rail 107. Alternatively, if plastic is selected the frame 101 can be formed from molded plastic as a single unit.

The mounting plate 102 is a board or plate that provides a surface upon which the fan 103, components of the detent 104, and components of the positioning device 105 are mounted. The width 138 of the mounting plate 102 and the depth 139 of the mounting plate 102 are sized so that the mounting plate 102 will fit into the left groove 140 of the left rail 106. The width 138 of the mounting plate 102 and the depth 139 of the mounting plate 102 are sized so that the mounting plate 102 will fit into the right groove 141 of the right rail 107. By sizing the width 138 of the mounting plate 102 and the depth 139 of the mounting plate 102 to fit within the left groove 140 and the right groove 141 simultaneously, the left groove 140 and the right groove 141 act as tracks to keep the mounting plate 102 in position as the mounting plate 102 is raised or lowered by the positioning device 105. The mounting plate 102 can be made of wood, metal, or plastic.

The fan 103 comprises a wall mountable fan 113 and mounting hardware 114. Wall mountable fans with the associated mounting hardware are readily and commercially available. The wall mountable fan 113 is mounted on front 135 side of the mounting plate 102 using the mounting hardware 114 provided with the wall mountable fan 113. The detent 104 comprises a left notched bar 115, a right notched bar 116, a left catch 117, a right catch 118, a spring 119 and a catch tube 120.

The left notched bar 115 is a shaft with a plurality of indexed notches 144 formed in it. The plurality of indexed notches 144 form a saw tooth type edge that will be used by the detent 104 to hold the mounting plate 102 in position. Each of the plurality of indexed notches 144 is formed with a base 145 and a rise 146. The base 145 forms a surface that runs in the width 138 direction perpendicular to the left rail 106. The rise 146 runs from the left 131 side of the left base 145 towards the top 133 of the invention 100 so that there is a first angle 147 of between 50 degrees and 70 degrees between the base 145 and the rise 146. The rise 146 ends when it crosses a hypothetical line that is perpendicular to the base 145 and placed at the right 132 side of the base 145. The left notched bar 115 is sized to fit into the left groove 140 and is positioned so that the plurality of indexed notches 144 faces away from the left 131 side of the left rail 106.

The right notched bar 116 is identical to the left notched bar 115 but is, in effect, rotated around its height 137 axis 180 degrees. The right notched bar 116 is sized to fit into the right groove 141 and is positioned so that the plurality of indexed notches 144 faces away from the right 132 side of the right rail 107.

Figure 5:
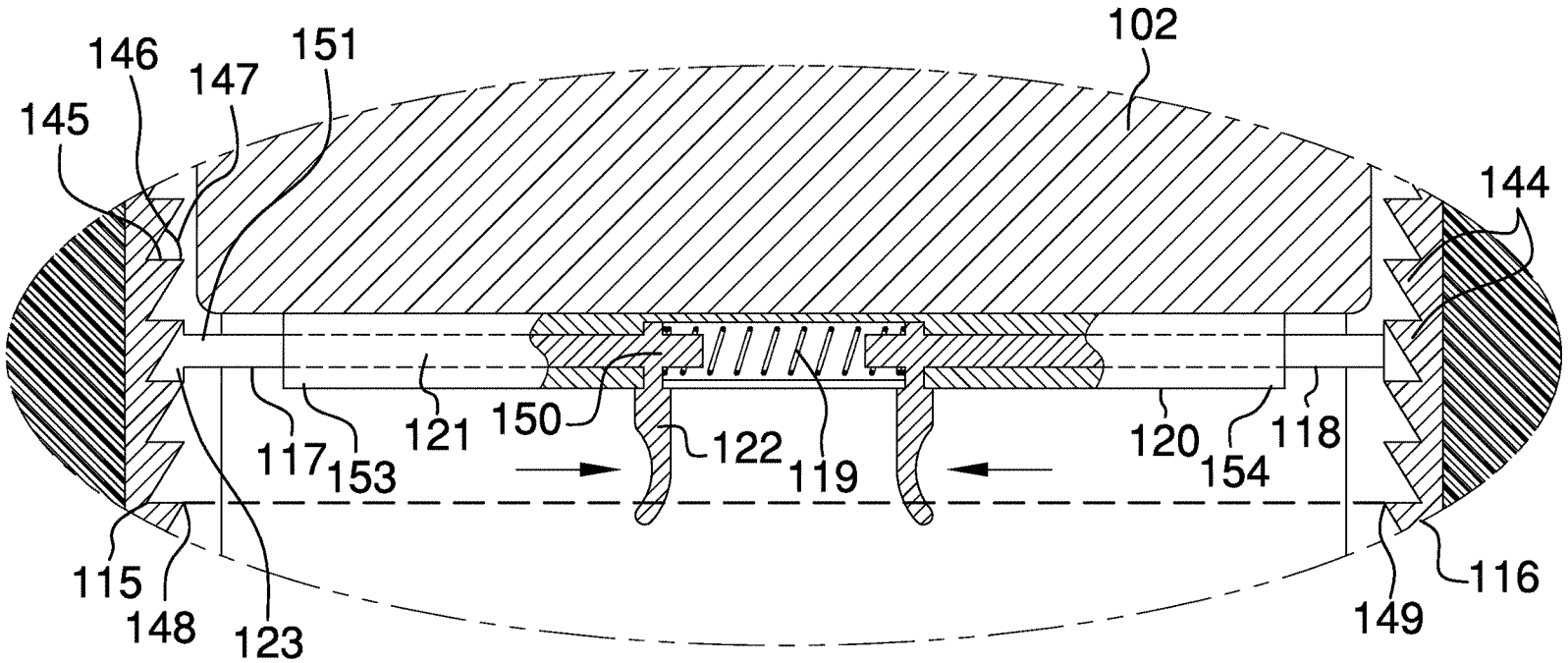
FIG. 5 is a detailed view of an embodiment of the disclosure.

The left notched bar 115 is positioned in the left groove 140, and the right notched bar 116 is positioned the in the right groove 141 such that the base 145 of each of the plurality of indexed notches 144 of the left notched bar 115 is aligned with a corresponding base 145 in the plurality of indexed notches 144 of the right notched bar 116. By aligned is meant that the span in the height 137 direction from the bottom 134 of the left rail 106 to a base 145 from the plurality of indexed notches 144 of the left notched bar 115 is the same as the span in the height 137 direction from the bottom 134 of the right rail 107 to the corresponding base 145 from the plurality of indexed notches 144 of the right notched bar 116. For clarity, FIG. 5 shows a first selected base 148 from the left notched bar 115 and the first corresponding base 149 from the right notched bar 116.

The left notched bar 115 and the right notched bar 116 can be formed from wood, metal or molded plastic. Methods for making a series of notches in a bar are well known and documented in the art. Depending on the material used, the left notched bar 115 can be glued, welded or attached with hardware into the left groove 140. If the frame 101 is made of molded plastic or wood, the left notched bar 115 may be formed as part of the frame 101. Depending on the material used, the right notched bar 116 can be glued, welded or attached with hardware into the right groove 141. If the frame 101 is made of molded plastic or wood, the right notched bar 116 may be formed as part of the frame 101.

The purpose of the left catch 117 is to wedge between a selected base 145 and rise 146 of one of the plurality of indexed notches 144 of the left notched bar 115 to hold the mounting plate 102 in position. The purpose of the right catch 118 is to wedge between a selected base 145 and rise 146 of one of the plurality of indexed notches 144 of the right notched bar 116 to hold the mounting plate 102 in position. The left catch 117 comprises a bar 121, a grip 122, and a tip 123. The bar 121 is further defined with a first end 150 and a second end 151. The grip 122 is mounted on the first end 150 of the bar 121. The tip 123 is mounted on the second end 151 of the bar 121. The tip 123 is shaped in the form of a triangular wedge that is sized to fit into the first angle 147. The right catch 118 is identical to the left catch 117.

The bar 121 is a commercially available metal bar. The grip 122 is a commercially available hand grip and is attached to the bar 121 using commercially available hardware. The tip 123 is a triangular wedge made of metal. The tip 123 is attached to the bar 121 by tapping the tip 123, threading the second end 151 of the bar 121 and screwing the second end 151 of the bar 121 into the tip 123. Tips 123 are commercially available. Alternatively, methods for making a tip 123 are well known and documented in the art.

The catch tube 120 acts as the container that holds the left catch 117, the right catch 118, and the spring 119. The catch tube 120 is a hollow tube with an open third end 152 and an open fourth end 153. A slot 154 is formed in the catch tube 120 to allow the grip 122 of the left catch 117 and the grip 122 of the right catch 118 to fit into the catch tube 120 through the slot 154. The left catch 117 is placed into the catch tube 120 so that the tip 123 of the left catch 117 extends beyond the third end 152 of the catch tube 120. The right catch 118 is placed into the catch tube 120 so that the tip 123 of the right catch 118 extends beyond the fourth end 153 of the catch tube 120.

The spring 119 is a helical compression spring that is placed in the catch tube 120 so that it is between the grip 122 end of the left catch 117 and the grip 122 end of the right catch 118. The catch tube 120 is attached to the bottom 134 of the mounting plate 102 so that tip 123 of the left catch 117 faces the left notched bar 115 and the tip 123 of the right catch 118 faces the right notched bar 116. Methods to attach the catch tube 120 to the mounting plate 102 include, but are not limited to, using commercially available hardware. The spring 119 is a commercially available helical compression spring.

The detent 104 works as follows. The left catch 117 is initially wedged between the base 145 and the rise 146 of an indexed notch selected from the plurality of indexed notches 144 on the left notched bar 115. The right catch 118 is initially wedged between the base 145 and the rise 146 of the corresponding indexed notch identified from the plurality of indexed notches 144 on the right notched bar 116. The left catch 117 and the right catch 118 are held in position by the spring 119 which pushes the left catch 117 and the right catch 118 into the left notched bar 115 and the right notched bar 116 respectively.

When the positioning device 105 is used to raise the mounting plate 102, the first angle 147 of the rise 146 exerts pressure in the width 138 direction compressing the spring 119. This continues until the left catch 117 and the right catch 118 are raised above the end of their respective rise 146. At that point the spring 119 relaxes and then: 1) pushes the left catch 117 back into the first angle 147 created by the base 145 and rise 146 created by the next notch in the left notched bar 115; and, 2) pushes the right catch 118 back into the first angle 147 created by the base 145 and rise 146 of the next notch in the right notched bar 116. To lower the mounting plate 102, the grip 122 of the left catch 117 and the grip 122 of the right catch 118 are pushed towards each other until the tip 123 of the left catch 117 and the tip 123 of the right catch 118 have both cleared their respective rise 146. The positioning device 105 can then be used to lower the mounting plate 102.

The positioning device 105 comprises an eyebolt 127, a pulley 128, a cleat 129 and a cord 130. The eyebolt 127 is mounted at the top 133 and center 157 of the mounting plate 102. The pulley 128 is mounted at the bottom 134 and center 157 of the top cross brace 108. In the first potential embodiment of the invention 100, the cleat 129 is mounted on the right rail 107. In a second potential embodiment the cleat 129 is mounted on the left rail 106. The cord 130 is further defined with a fifth end 155 and a sixth end 156. The fifth end 155 of the cord 130 is tied off at the eyebolt 127. The sixth end 156 of the cord 130 is the run through the pulley 128. To raise the mounting plate 102, the cord 130 is pulled down on. To lower the mounting plat 102, cord 130 is fed into the pulley 128 while pushing the left 131 grip 122 and right 132 grip 122 together. This allows gravity to lower the mounting plate 102. When the mounting plate 102 is in the desired position, the left 131 grip 122 and right 132 grip 122 are released and the sixth end 156 of the cord 130 is tied off on the cleat 129 in order to protect against the detent 104 failing.

Commercially available hardware is used for the eyebolt 127, the pulley 128, and the cleat 129. Commercially available cord may be used for the cord 130.

To use the invention 100, the invention 100 is first secured to a wall using commercially available anchors and hardware. Once secured, the fan 103 is plugged into an electrical power source. The cord 130 is released and the mounting plate 102, with the fan 103, is raised or lowered into the desired position and the fan 103 is turned on.

The following definitions and directional references were used in this disclosure:

Detent: As used in this disclosure, a detent is a device for positioning and holding one mechanical part in relation to another in a manner such that the device can be released by force applied to one or more of the parts.

Directional References: The directional references of this disclosure correspond to the directional references when facing the invention 100 while mounted on a wall for use. The left 131 side of the invention 100 is the side to the viewer's left when facing the invention 100. The right 132 side of the invention 100 is the side to the viewer's right. The top 133 side of the invention 100 is one side in the clockwise direction from the left 131 side of the invention 100. The bottom 134 side of the invention 100 is one side in the clockwise direction from the right 132 side of the invention 100. The front 135 side of the invention 100 is the face of the invention 100 closest to the viewer. The rear 136 side of the invention 100 is the side distal from the front 135 side. The height 137 direction runs from the bottom 134 to the top 133 of the invention 100. The width 138 direction runs perpendicular to the height 137 direction from the left 131 side of the invention 100 to the right 132 side of the invention 100. The depth 139 direction runs perpendicular to the height 137 and the width 138 direction from the front 135 side to the rear 136 side of the invention 100. The center 157 is half way between the left 131 side and the right 132 side of the invention.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An adjustable fan comprising:

a frame, a mounting plate, a detent, and a positioning device;

wherein the mounting plate is adapted to support a fan thereon;

wherein the adjustable fan is adapted to be mounted on a wall;

wherein the height of the fan can be raised or lowered;

wherein the detent comprises a left notched bar, a right notched bar, a left catch, a right catch, a spring, and a catch tube;
wherein the frame comprises a left rail, a right rail, a top cross brace and a bottom cross brace;
wherein the left rail comprises a left plank and a left groove;
wherein the left groove is formed into the left plank;
wherein the right rail comprises a right plank and a right groove;
wherein the right groove is formed into the right plank;
wherein the left groove is further defined by a left groove width and a left groove depth;
wherein the right groove is further defined by a right groove width and a right groove depth;
wherein the fan is adapted to be mounted on the mounting plate;
wherein the width of the mounting plate and the depth of the mounting plate are sized so that the mounting plate will fit into the left groove of the left rail;
wherein the width of the mounting plate and the depth of the mounting plate are sized so that the mounting plate will fit into the right groove of the right rail;
wherein the left groove and right groove act as tracks that keep the mounting plate in position when the mounting plate is being raised or lowered by the positioning device;
wherein the top cross brace connects the left rail to the right rail;
wherein the bottom cross brace connects the left rail to the right rail;
wherein the span of the height of the left rail is equal to the span of the height of the right rail;
wherein the span of the width of the top cross brace is equal to the span of the width of the bottom cross brace;
wherein the left rail is positioned to be parallel to the right rail;
wherein the top cross brace is positioned to be parallel to the bottom cross brace;
wherein the top cross brace is positioned to be perpendicular to both the left rail and the right rail;
wherein the bottom cross brace is positioned to be perpendicular to both the left rail and the right rail;
wherein the width and depth of the left groove is identical to the width and the depth of the right groove;
wherein the left notched bar is a shaft with a plurality of indexed notches formed in it;
wherein each of the plurality of indexed notches is formed with a base and a rise;
wherein the base forms a surface that runs in the width direction perpendicular to the left rail;
wherein the rise runs from the left side of the left base towards the top of the adjustable fan so that there is a first angle of between 50 degrees and 70 degrees between the base and the rise;
wherein the left notched bar is sized to fit into the left groove;
wherein the left notched bar is positioned so that the plurality of indexed notches faces away from the left side of the left rail;
wherein the right notched bar is identical to the left notched bar;
wherein the right notched bar is sized to fit into the right groove;
wherein the right notched bar is positioned so that the plurality of indexed notches of the right notched bar faces away from the right side of the right rail;
wherein the left notched bar is positioned in the left groove and the right notched bar is positioned in the right groove so that the base of each of the plurality of indexed notches of the left notched bar is aligned with a corresponding base in the plurality of indexed notches of the right notched bar;
wherein the left catch comprises a bar, a grip, and a tip;
wherein the bar is further defined with a first end and a second end;
wherein the grip is mounted on the first end of the bar;
wherein the tip is mounted on the second end of the bar;
wherein the tip is shaped in the form of a triangular wedge that is sized to fit into the first angle;
wherein the right catch is identical to the left catch;
wherein the catch tube acts as the container that holds the left catch, the right catch and the spring;
wherein the catch tube is a hollow tube further defined with a third end and a fourth end;
wherein the third end is open;
wherein the fourth end is open;
wherein a slot is formed in the catch tube
wherein the left catch is placed into the catch tube so that the tip of the left catch extends beyond the third end of the catch tube;
wherein the right catch is placed into the catch tube so that the tip of the right catch extends beyond the fourth end of the catch tube;
wherein the spring is a helical compression spring;
wherein the spring is placed in the catch tube so that it is between the grip end of the left catch and the grip end of the right catch;
wherein the catch tube is attached to the bottom of the mounting plate so that tip of the left catch faces the left notched bar and the tip of the right catch faces the right notched bar;
wherein the positioning device is used to raise the mounting plate;
wherein the positioning device comprises an eyebolt, a pulley, a cleat and a cord;
wherein the cord is further defined with a fifth end and a sixth end;
wherein the eyebolt is mounted at the top and center of the mounting plate;
wherein the pulley is mounted at the bottom and center of the top cross brace;
wherein the cleat is mounted at a location selected from a group of locations consisting of the left rail or the right rail;
wherein the fifth end of the cord is tied off to the eyebolt.

2. An adjustable fan comprising:
a frame, a mounting plate, a detent, and a positioning device;
wherein the mounting plate is adapted to support a fan thereon;
wherein the adjustable fan is mounted on a wall;
wherein the height of the fan can be raised or lowered;
wherein the detent comprises a left notched bar, a right notched bar, a left catch, and a right catch;
wherein the left notched bar is a shaft with a plurality of indexed notches formed in it;
wherein each of the plurality of indexed notches is formed with a base and a rise;
wherein the left notched bar is attached to the frame;
wherein the right notched bar is identical to the left notched bar;
wherein the right notched bar is attached to the frame;

wherein the left notched bar is positioned in the frame and the right notched bar is positioned the in the frame so that the base of each of the plurality of indexed notches of the left notched bar is aligned with a corresponding base in the plurality of indexed notches of the right notched bar;

wherein the positioning device is used to raise and lower the mounting plate;

wherein when the positioning device raises the mounting plate up one of the plurality of indexed notches, the positioning device exerts a force on the left grip pushing it towards the mounting plate;

wherein when the positioning device raises the mounting plate one of the plurality of indexed notches, the positioning device exerts a force on the right grip pushing it towards the mounting plate.

* * * * *